United States Patent [19]

Garran

[11] Patent Number: 4,946,039

[45] Date of Patent: Aug. 7, 1990

[54] SIGN DISPLAY KIT

[75] Inventor: Joseph F. Garran, Northfield, Ohio

[73] Assignee: Vanguard Marketing Group, Northfield, Ohio

[21] Appl. No.: 395,030

[22] Filed: Aug. 16, 1989

[51] Int. Cl.[5] ..... G09F 15/00; B65D 69/00

[52] U.S. Cl. ..... 206/575; 40/606; 40/607; 383/106

[58] Field of Search ..... 206/1.7, 224, 575; 383/9, 106, 902; 40/584, 586, 607, 608, 611, 606

[56] References Cited

U.S. PATENT DOCUMENTS

| | | | |
|---|---|---|---|
| 2,132,799 | 10/1938 | Ostrander | 40/611 |
| 3,250,241 | 5/1966 | Levy et al. | 40/607 |
| 3,470,639 | 10/1969 | Ihling | 40/586 |
| 3,609,894 | 10/1971 | Miller, III | 40/607 |
| 4,601,255 | 7/1986 | Marcotti | 40/591 X |
| 4,667,829 | 5/1987 | Edmund-White | 206/575 |
| 4,722,145 | 2/1988 | Prest | 40/584 |
| 4,793,082 | 12/1988 | Petrick et al. | 40/607 |

FOREIGN PATENT DOCUMENTS

| | | | |
|---|---|---|---|
| 1186898 | 5/1985 | Canada | 40/606 |
| 037145 | 10/1981 | European Pat. Off. | 40/611 |
| 735905 | 9/1932 | France | 40/611 |
| 1058247 | 2/1967 | United Kingdom | 40/606 |
| 1267932 | 3/1972 | United Kingdom | 40/607 |

*Primary Examiner*—William I. Price
*Attorney, Agent, or Firm*—Oldham & Oldham

[57] ABSTRACT

The sign display kit including a flexible transparent waterproof plastic container which contains the other materials in the kit; i.e. a sign, a stake, a rubber band for mounting the sign on the stake, and optionally one or more rubber balloons. The container is an envelope or bag formed from two plies of plastic sheet. The sign has a front surface which can be marked with a marking instrument, and which has on the front surface a printed message and a space in which handwritten information can be filled in. The stake is tapered at one end for driving into the ground. The printed message announces an event which is a cause for celebration, such as a birth, and may rear "It's a Boy" or "It's a Girl". The baby's name is filled in by hand, using a suitable marking instrument. The plastic container may be placed over the sign to form a waterproof cover therefor. The stake may be driven into the ground and the sign secured to the stake by looping the rubber band around the stake immediately above and immediately below the sign. The stake is behind the sign and the rubber band is in front in the assembled display.

16 Claims, 1 Drawing Sheet

SIGN DISPLAY KIT

TECHNICAL FIELD

This invention relates to a sign display kit which includes a flexible plastic container, a sign having both pre-printed information and a space for filling in additional information by hand, a stake, and means for securing the sign to the stake.

BACKGROUND ART

Signs in a variety of forms and for a variety signs (such as speed limit signs) and information signs (e.g., historical markers, and signs indicating direction and distance to a given city or town) represent just a few types of signs. Usually, all of the information on the sign is painted or otherwise printed thereon in large, easily read letters and symbols.

Another common type of informational sign is a "For Sale" sign announcing that a house is for sale. Such a sign, which usually includes the name and telephone number of the realtor, is ordinarily permanently attached to a stake (e.g., a metal pipe or rod) which can be driven into the ground.

Much less numerous are signs requiring some information to be filled in. Such signs may include announcements of a transitory nature, such as a parking ban of a temporary nature, wherein the sign may include a printed message such as "Emergency—No Parking From_to_" with the times denoting the start and the end of the parking ban filled in by hand in the blanks.

Portable billboards for announcing special occasions, such as birthdays and anniversaries, have become popular in recent years. Such a sign typically includes an upright easel with a supporting structure for removable letters. Such signs are frequently illuminated. Removable letters are inserted to spell out the desired message, e.g., "Happy Birthday, Sam". Such signs have two objections: they are large (several feet wide and several feet high), ostentatious, and comparatively expensive to rent.

Signs for announcing special occasions are also commercially available. These fall generally into two categories: those in which the sign as sold to the user is affixed to a stake (e.g., by glue or staples), and those in which the sign is supplied without mounting materials (e.g., a stake and some means for securing the sign to the stake).

DISCLOSURE OF THE INVENTION

The present invention provides a sign display kit, especially suitable for announcing an event such as a birth, a birthday or an anniversary and containing all the materials which constitute parts of the sign display when set up.

The sign display kit of this invention comprises:

(a) a flexible waterproof plastic container;

(b) a single sign having a surface which can be marked by hand with a marking instrument, such surface having thereon a printed message announcing a cause for celebration and a space for information written by hand;

(c) a stake; and (d) a longitudinally stretchable mounting device for attaching said sign to said stake; said sign and said stake being separate from each other in said This invention according to another aspect provides a sign display assembly comprising:

(a) a sign having a surface which can be marked by hand with a marking instrument, said surface having thereon a printed message announcing a cause for celebration and a space for handwritten information;

(b) a flexible transparent waterproof cover covering said sign;

(c) a stake; and (d) a longitudinally stretchable mounting device for attaching said sign to said stake, said sign being secured by means of said mounting device to said stake so that the back surface of the sign is in touching engagement with the stake and said mounting device extends in front of the sign and in contact therewith from the top edge to the bottom edge of the sign and engages the stake immediately above and immediately below the sign, said mounting device pressing said sign against said stake.

BEST MODE FOR CARRYING OUT THE INVENTION

This invention will now be described in detail with particular reference to the best mode and preferred embodiment thereof.

Figure 1:
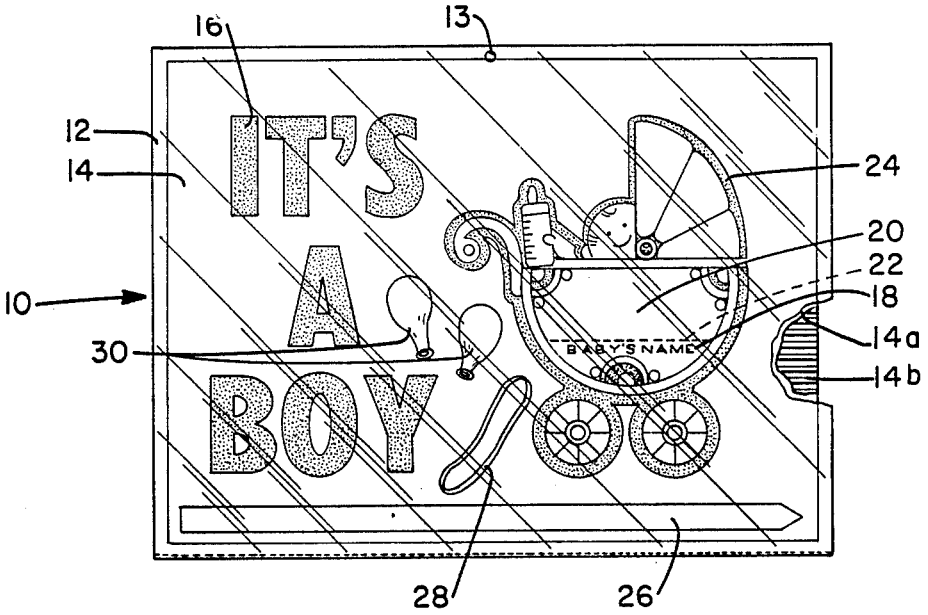
FIG. 1 is a front elevational view of a sign display kit according to this invention, with a portion broken away to show corrugation.

Referring now to FIG. 1, 10 is a sign display kit according to this invention. Kit 10 comprises a flexible transparent waterproof plastic container 12, made of plastic sheet (e.g., polyvinyl chloride or PVC) and in the form of a sealed rectangular bag or envelope. The container 12 contains all of the materials, except a hammer and a marker, which are needed to erect a sign display in accordance with this invention.

The container or bag 12 may be formed by conventional means, e.g., by folding a rectangular plastic sheet along the transverse center line and sealing along the other three edges by stretching or heat sealing after all of the contents have been placed inside. Bag 12 may have a pair of aligned hanger holes 13, one in each ply of plastic sheet which forms the bag, close to the top edge of the bag, so that the package 10 may be hung on a display board or peg board.

Inside container 12 is a rectangular sign 14, whose height and width are just slightly smaller than the corresponding dimensions of the container. The sign 14 is made of an inexpensive rigid or semi-rigid material; corrugated cardboard is preferred. The corrugated cardboard may be conventional, comprising a thin flat cardboard face sheet or layer which provides front surface **14*a*, a middle layer having horizontally extending flutes or corrugations 14*b*, and a thin flat cardboard back sheet or layer 14*c* which provides a back surface. At least one surface, i.e., the front surface of sign 14**, is capable of being marked by hand with a suitable marking instrument so that clearly visible characters appear. The preferred corrugated cardboard sign has cardboard front and back surfaces which can be marked with a broad felt tipped marker, such as a "Magic Marker" or similar marking instrument which contains a colored marking fluid. (Whether or not the back surface of the sign 14 can be marked with a marking instrument is ordinarily not important; however, for convenience, the front and back surfaces of the sign are usually made of the same material).

The front surface of sign 14 has printed material, including a printed message 16 which imparts information and typically announces an event, a legend 18 which calls for certain information to be filled in by hand, a space 20 for filling in such additional information, and optionally additional printed material 22.

The event announced in the printed message 16 is a cause for celebration. For instance, message 16 may announce a birth with words such as "It's a Boy", "It's a Girl", or "We're Grandparents". This message is printed in type large enough to be readable at a distance of at least about 40 to 50 feet, so that the message can be read by a passerby in an automobile on the street when the sign is set back about 15 to 20 feet from the street edge. The legend 18, calling for information to be filled in, may simply read "Baby's Name" in small type. Adjacent to this legend 18 (either directly above or alongside) is a space 20 for filling in the information indicated by legend 18. For example, in the illustrations given, the name of the newborn infant may be filled in with a marking instrument in space 20. A dotted line 22 (optional) may be provided immediately above the legend 18 and below the space 20. The front surface of sign 14 may contain additional printed matter 24, for example a baby carriage with a baby's face as shown in the drawings when the sign contains an announcement of a birth.

Sign 14 may be printed on both sides, one side reading, for example, "It's a Boy" and the other side reading, "It's a Girl", with a legend 18 ("Baby's Name"), fill-in space 20, and optionally a dotted line 22 and additional printed matter 24 (e. g., a baby carriage) on both sides. The user erects the sign so that the appropriate side faces outwardly toward the street or road.

Sign 14 may contain other messages. For example, the printed message 16 may read "Happy Birthday" and the legend 18 may read "Name", indicating that the name of the person having the birthday is to be filled in in space 20. A few illustrations of messages have been given; any one of a variety of messages may be printed on a sign 14. The message announces a cause for celebration, such as a birth, a birthday or an anniversary.

Also inside the container 12 is a stake 26, typically made of wood or a rigid plastic and tapered at one end so that it may be driven easily into the ground. The length of the stake 26 must be greater than the height of the sign 14. The length of the stake 26 is not greater than (and preferably is slightly less than) the width of sign 14. This stake 26 and the sign 14 are not pre-assembled; that is, each is placed as a separate piece inside the container 12. Preferably stake 26 extends cross-wise inside container 20. It is desirable not to pre-assemble the sign 14 and the stake 26, because if they were pre-assembled the container 14 would have to be larger and there would be an appreciable danger that the lower portion of the stake (the portion not fixed to the sign) would be broken or that the tapered end of the stake would pierce the plastic sheet container 12.

Kit 10 also contains suitable means for attaching sign 14 to stake 26. While the kit may include short nails or carpet tacks for this purpose, it is far preferable to provide a rubber band 28 or other longitudinally stretchable mounting device, such as an elastic. A rubber band is inexpensive, easy to use and non-hazardous.

Finally, kit 10 may contain one or more inflatable balloons 30. Conventional toy rubber balloons, which can be inflated by mouth, are preferred.

The background color of the front surface of sign 14 (and also the back surface when the sign is printed on both sides) is usually either white or some light color, such as light grey, beige or light blue, so that printed message 16 and the message written by hand in space 20 will be clearly visible.

Sign 14 is usually intended for a single use. An inexpensive and rigid or semi-rigid sign material is required in this situation, and corrugated cardboard is ideal. Other suitable materials will be apparent to those skilled in the art. The surface for such nonreusable sign must be sufficiently porous to accept the marking fluid of a broad felt tipped marking instrument. A reusable sign in accordance with this invention may also be made. For example, the sign 14 may be a conventional "white board" having a rigid backing and an essentially nonporous, usually high gloss, white surface on which one can write with a dry marker. Writings made in this manner can be erased by wiping with a clean cloth. Such sign may contain printed material as aforedescribed plus a space 20 for the handwritten message, which is written in with the dry marker. A reusable sign of this type is particularly useful for persons and organizations who repeatedly stage events of the same type, such as professional garage sale operators.

To assemble a sign in accordance with this invention, one first cuts open the plastic container or bag 12 along the bottom or top edge thereof. The cutting is made easier if one grasps the hanger holes 13 at the top of the container !2 and cuts along the fold line at the top edge. Next, one removes the contents of the bag 12 and fills in the appropriate information (the name of the newborn baby when the printed legend 16 is a birth announcement) in space 20. A broad felt-tipped marker of any color desired by the user may be used on a paper or cardboard surface. (Other suitable marking instruments have been indicated above for other sign surfaces). It is desirable to slip the transparent plastic bag 12 over the sign 14 after the appropriate information has been filled in in space 20 so that the sign will be waterproof. Thus, the plastic bag 12 forms a waterproof cover for sign 14.

Next, one drives the stake 26 into the ground. An ordinary hammer may be used for this purpose. The depth to which the stake is driven (typically about 5 to 6 inches) must be sufficient to assure stability of the assembled sign but sufficiently small so that the above ground height of the stake 26 is greater than the height of the sign 14. This makes it possible for the user to attach this sign 14 to stake 26 by means of a rubber band, and to position the sign at desired height provided that the top of stake 26 is visible above the top edge of sign 14. Next, one loops the rubber band 28 behind the stake 26, lowers the portion behind the stake to ground level, and gently pulls the rubber band toward oneself. Next, one places the sign 14 above the rubber band 28 and in front of and against the stake 26, so that the top edge of the sign is below the top of the stake. One can move the sign 14 up or down along stake 26 and thereby position the sign at desired height. Then one pulls the rubber band upwardly in front of the sign 14 and loops the rubber band over the top of and behind the stake 26.

Figure 2:
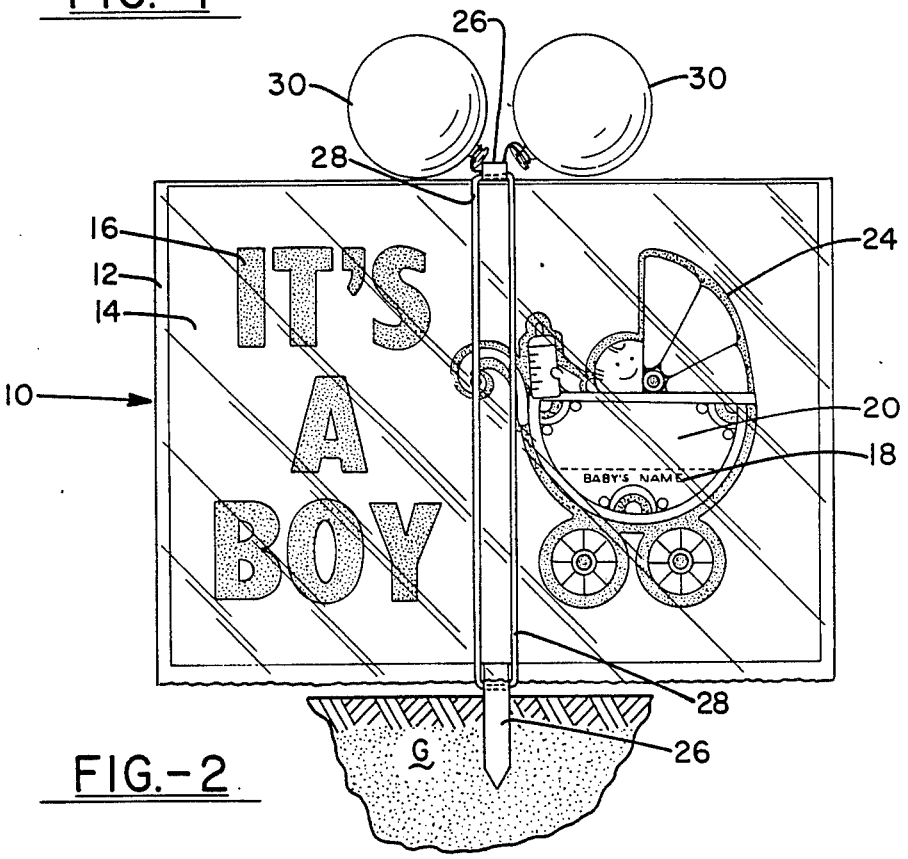
FIG. 2 is a front elevational view of a sign assembly in accordance with this invention.

A finished sign display according to this invention is shown in FIG. 2. Referring to FIG. 2, sign display 32 includes a sign 14 as above described, mounted on a stake 26 by means of a stretched rubber band 28. The stretched rubber band 28 extends in front of sign 14 from top to bottom and is looped around (i.e. behind) the stake 26 immediately above and immediately below the sign 14. (The unstretched rubber band is shorter than the height of sign 14). The two parallel strands of the stretched rubber band 28 press against the front surface of sign 14, holding the back surface of the sign in firm contact with the stake 26.

The front surface of the sign 14 includes both printed material as above described and a handwritten message in space 20. Stake 26 is driven into the ground approximately 5 to 6 inches and in any case sufficiently far to impart stability to the display assembly 32. However, the above ground portion of stake 26 must be longer than the height of sign 14, so that the rubber band 28 can be looped around the sign 14 in the manner shown and described.

The corrugations **14*b* in the assembled sign 14** run horizontally, i.e. parallel to the ground and to the top and bottom edges of the sign. This is important, because vertically extending corrugations are prone to "catch the wind" while horizontally extending corrugations stabilize the sign so that it is less apt to be blown over by a gust of wind.

Other longitudinally stretchable mounting devices (e.g., elastic or a coil spring with a loop at each end) which may be secured to the stake 26 above and below the sign 14 may be used, but a rubber band is preferred because of its simplicity, low cost and ease of use.

The sign assembly of this invention is inexpensive, in good taste, non-hazardous, and easily set up, even by persons having relatively no mechanical skill.

Throughout the specification and claims, "printed" is used to denote material which is preprinted on the sign 14 before the kit or package 10 is assembled, and does not refer to the style of lettering. Thus, script letters may be used to form message 16, although ordinarily block printed letters or capital and lower case printed letters are preferred. The pre-printed material is printed on the front surface of the sign by conventional printing, stenciling or painting techniques. By the same token, "handwritten" refers to material which the user of the sign marks on the sign with a marking instrument, and not to the style of lettering. The handwritten material may be and preferably is printed in block letters.

While this invention has been described with particular reference to the best mode and preferred embodiment thereof, it is understood that the invention is not limited thereto or thereby, but rather is measured by the scope of the appended claims.

What is claimed is:

1. A sign display kit comprising:

(a) a flexible waterproof plastic container;

(b) a single sign having a surface which can be marked by hand with a marking instrument, said surface having thereon a printed message announcing a cause for celebration and a space for.information written by hand;

(c) a stake; and (d) a longitudinallly stretchable mounting device for attaching said sign to said stake, said sign and said stake being separate from each other in said kit.

2. A kit according to claim 1, further including at least one inflatable balloon.

3. A kit according to claim 1 in which said container is transparent.

4. A kit according to claim 1 in which said surface of said sign cardboard.

5. A kit according to claim 1 in which said sign is made of corrugated cardboard.

6. A kit according to claim 1 in which said surface of said sign has a printed message imparting information and a printed legend indicating the type of information to be filled in by hand in said space.

7. A kit according to claim 6 further including a dotted line immediately above said legend and immediately below said space for information written by hand.

8. A kit according to claim 1 in which said stake is tapered at one end to facilitate driving into the ground.

9. A kit according to claim 1 in which said mounting device for attaching said sign to said stake is resilient.

10. A kit according to claim 9 in which said means for attaching said sign to said stake is a rubber band.

11. A sign display assembly comprising:

(a) a sign having a front surface which can be marked by hand with a marking instrument, said surface having thereon a printed message and a space containing handwritten information;

(b) a flexible transparent waterproof cover covering said sign;

(c) a stake; and (d) a longitudinally stretchable mounting device for attaching said sign to said stake;

said sign being secured to said stake by means of said mounting device so that the back surface of the sign is in touching engagement with the stake and said mounting device extends in front of the sign and in contact therewith from the top edge to the bottom edge of the sign and engages the stake immediately above and immediately below the sign, said mounting device pressing said sign against said stake.

12. A sign display assembly according to claim 11, further including at least one inflated balloon secured to the assembly.

13. A sign display assembly according to claim 11 in which the front surface of the sign has a printed message imparting information and a printed legend indicating the type of information to be filled in by hand in said space.

14. A sign display assembly according to claim 11 in which said printed message is a message announcing a cause for celebration and further including a dotted line immediately above said legend and immediately below said space.

15. A sign display assembly according to claim 11 in which said stake is tapered at one end and driven into the ground.

16. A sign display assembly according to claim 11 in which said longitudinally stretchable mounting device for securing said sign to said stake is a rubber band.

* * * * *